US006673228B1

(12) United States Patent
Kivistö et al.

(10) Patent No.: US 6,673,228 B1
(45) Date of Patent: Jan. 6, 2004

(54) ARRANGEMENT FOR CLEANING THE BOTTOM OF AN ELECTROLYTIC TANK

(75) Inventors: Tuomo Kivistö , Kirkkonummi (FI); Jari Stenroos, Noormarkku (FI)

(73) Assignee: Outokumpu Oyj, Espoo (FI)

( * ) Notice: Subject to any disclaimer, the term of this patent is extended or adjusted under 35 U.S.C. 154(b) by 68 days.

(21) Appl. No.: 09/980,438

(22) PCT Filed: May 30, 2000

(86) PCT No.: PCT/FI00/00481

§ 371 (c)(1),
(2), (4) Date: Jan. 4, 2002

(87) PCT Pub. No.: WO00/79025

PCT Pub. Date: Dec. 28, 2000

(30) Foreign Application Priority Data

Jun. 17, 1999 (FI) ..... 991390

(51) Int. Cl.[7] ..... C25C 7/06; C25C 7/00

(52) U.S. Cl. ..... 205/351; 204/242; 204/269; 204/270; 204/275.1; 204/277; 204/278

(58) Field of Search ..... 204/275.1, 278, 204/269, 270, 242, 277; 205/351

(56) References Cited

U.S. PATENT DOCUMENTS

| | | | | |
|---|---|---|---|---|
| 3,708,415 A | | 1/1973 | Hubbard | |
| 3,890,214 A | | 6/1975 | Kleveland | |
| 4,303,491 A | * | 12/1981 | Ferrari et al. | 204/250 X |
| 5,543,020 A | * | 8/1996 | Menendez et al. | 204/269 |

FOREIGN PATENT DOCUMENTS

| | | |
|---|---|---|
| EP | 0 646 662 | 4/1995 |
| JP | 11200085 | 7/1999 |
| WO | 98/42883 | 10/1998 |

* cited by examiner

*Primary Examiner*—Donald R. Valentine
(74) *Attorney, Agent, or Firm*—Smith-Hill and Bedell

(57) ABSTRACT

An arrangement for cleaning the bottom of an electrolytic tank of solids settled on the bottom of the tank, said arrangement comprising elements to be moved along the bottom or at least in the vicinity thereof in order to detach solids from the bottom. The arrangement comprises at least one moveable suction element, whereby at least part of the solids accumulated on the bottom is conducted out of the tank.

19 Claims, 6 Drawing Sheets

ARRANGEMENT FOR CLEANING THE BOTTOM OF AN ELECTROLYTIC TANK

Figure 1:
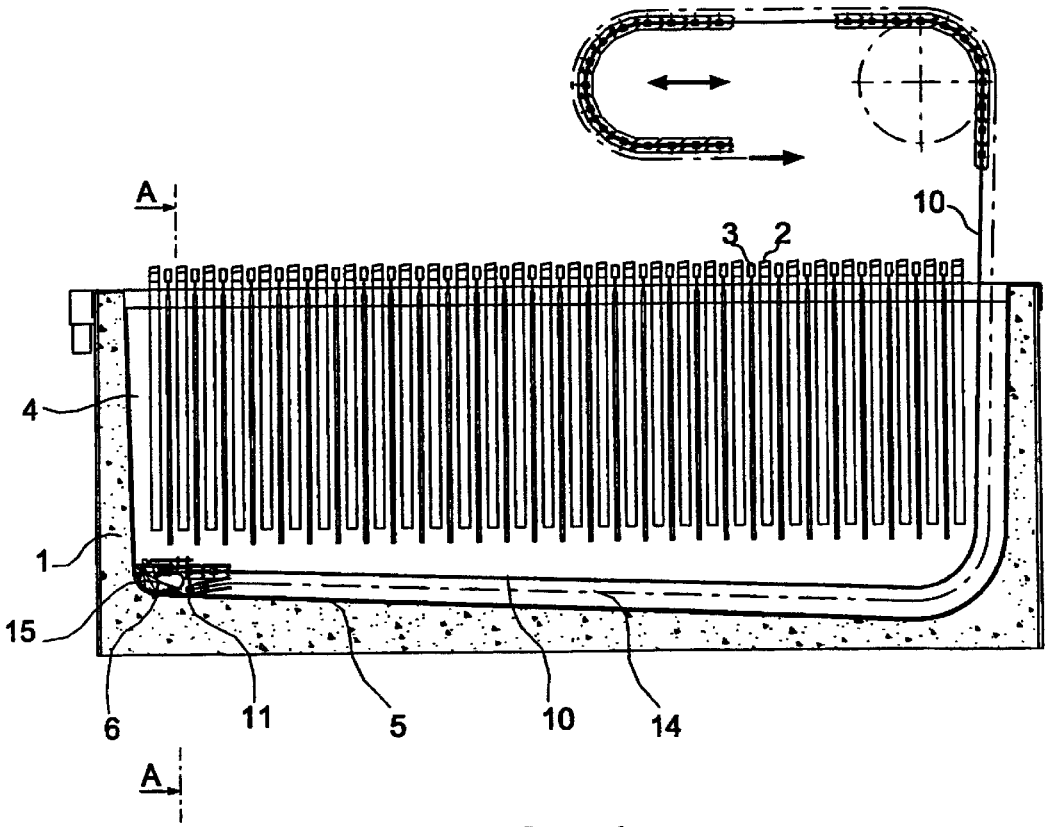

The present invention relates to an arrangement for cleaning the bottom of an electrolytic tank of solids settled thereon, said arrangement comprising elements to be moved along the bottom or at least in the vicinity thereof in order to detach solids from the bottom.

In electrolytic processes, metals such as copper, nickel and zinc, are precipitated on the surfaces of cathodes located in the electrolytic tank, starting either with metal anodes that are dissolved into the electrolyte present in the electrolytic tank, or with metal ions that are already dissolved into the electrolyte. However, all solids are not precipitated onto the cathode surfaces, for example precious metals and solid impurities present in the electrolyte. Therefore on the bottom of electrolytic tanks, there are accumulated, along with the metal refining process, various solids that must from time to time be removed from the tank, for instance because said solids contain valuable ingredients, such as precious metals, or because a thicker solids accretion threatens the purity of the cathode obtained from the electrolytic process.

Usually the solids accumulated in the electrolytic tank is are at least partly very finely divided and only somewhat heavier than the electrolyte, wherefore it is difficult to separate the solids from the electrolyte. During the electrolytic process, the circulation of the solids from off the bottom of the electrolytic tank is very harmful, because in that case there is a particularly high risk that the solids proceed onto the cathode, and this would essentially weaken the purity of the metal to be produced.

The removal of the solids accumulated on the bottom of an electrolytic tank usually requires that the whole electrolytic process must be interrupted, which reduces the efficiency per time, i.e. the productivity of the electrolytic plant. Hence the removal of solids must be arranged so that it forms part of the process of replacing the electrodes, i.e. anodes and cathodes; this, however makes the replacement process complicated and slow, and also restricts the removal of solids to take place in the rhythm dictated by the process of replacement. Moreover, a remarkable amount of the electrolyte must be first removed from the tank and then fed back therein, which generally leads to harmful effects in the electrolyte quality and causes a lot of extra work. Into the solids treatment system, there also flows a remarkable amount of electrolyte, which must be replaced with new and may be harmful in the further treatment of the solids. Moreover, the manual washing of the electrolytic tanks makes the process clearly more labor-intensive and subjects the employees to various health hazards, among others owing to the effects of the ingredients contained in the splashes and spray emanating from the tank. In addition, owing to the personnel required by the washing of the tanks, the automatization of the electrode treatment is often nearly impossible, which further increases the labor demand in an electrolytic plant.

From U.S. Pat. No. 6,299,756, there is known a separating element for separating the bottom part of an electrolytic tank from the rest of the tank space in connection with the removal of the solids settled on the tank bottom. In said publication, in the electrolytic tank there are arranged support and control members that form the trajectory of the separating element, so that the separating element can be placed in the electrolytic tank and removed therefrom through a space provided in between at least one end wall and the electrode placed nearest to said end wall. In the separating element, there can be attached means for feeding cleaning agent into the bottom part of the electrolytic tank, or mechanical devices for detaching solids. The detached solids are removed from the tank through an outlet aperture provided in the tank bottom, or by means of a separate pump.

The object of the present invention is to eliminate some of the drawbacks of the prior art and to achieve an improved arrangement for cleaning the bottom of an electrolytic tank of solids settled thereon, said arrangement comprising means to be moved along the bottom or at least in the vicinity thereof for detaching solids off the bottom. The essential novel features of the invention are apparent from the appended claims.

According to the invention, the arrangement also comprises at least one movable suction element whereby at least part of the solids accumulated on the bottom are conducted out of the tank. By means of the movable suction element, there is achieved an extremely efficient removal of solids from the tank.

The suction element according to the invention is a suction nozzle arranged essentially transversally to the motional direction of the arrangement, said suction nozzle preferably extending essentially along the whole width of the tank and being provided with at least one feed aperture and at least one discharge aperture. When the suction nozzle is placed transversally and extends to the whole width of the tank, there is achieved an extremely intensive suction effect, and the solids are removed by one motion of said suction element, by moving it from one end of the tank to the other end.

The suction element according to the invention comprises a housing, at the bottom part whereof there is formed at least one feed aperture, and in which housing there is preferably formed at least one discharge aperture that can be connected to a suction conduit. According to a preferred embodiment, in the suction nozzle there are made several feed apertures, in which case the apertures can serve as sieve members, thus breaking the solids accretions into smaller parts. According to another embodiment, in the suction nozzle there is made a longitudinal, slot-like feed aperture that extends to the whole width of the suction nozzle. Now the solids can be removed extremely efficiently, and at the same time the blocking of the feed apertures of the suction element can be avoided. According to a preferred embodiment of the invention, in connection with the suction nozzle, there is arranged at least one nozzle for feeding cleaning agent. By means of the nozzle for feeding cleaning agent, the proceeding of the solids into the suction nozzle can be boosted.

A suction nozzle in a preferred embodiment of the arrangement according to the invention comprises means for pressing the suction nozzle towards the tank bottom. Now an optimal solids removal effect of the suction nozzle can be ensured. The suction nozzle can be provided with mechanical solids detaching means, in which case the cleaning effect created by the suction nozzle is further improved. When the suction element according to the invention is attached to a separating wall element which at the same time serves as a drive element, there is obtained an extremely effective arrangement for removing solids from the bottom of an electrolytic tank.

Figure 2:
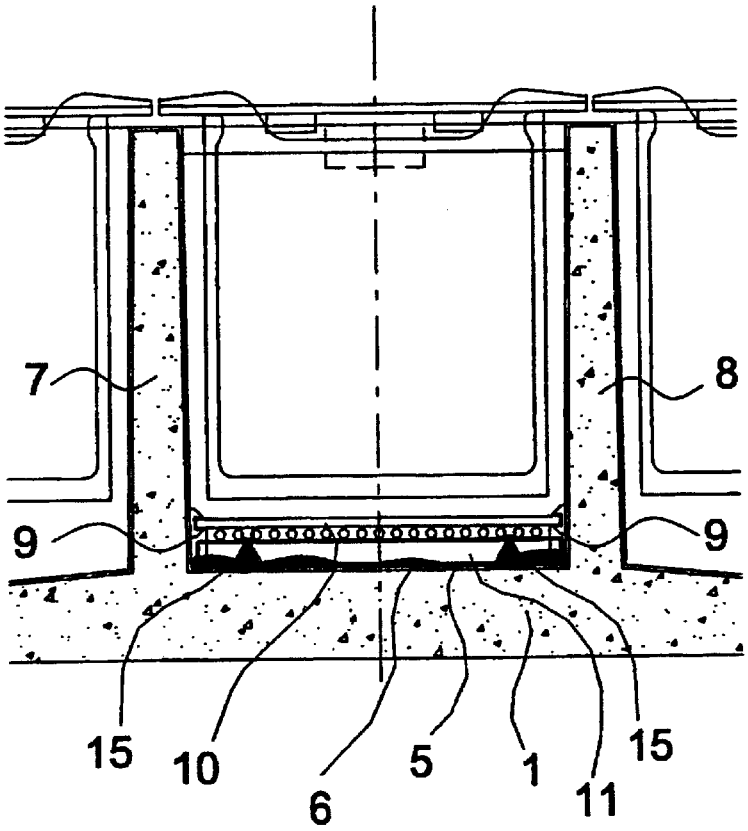
Figure 3:
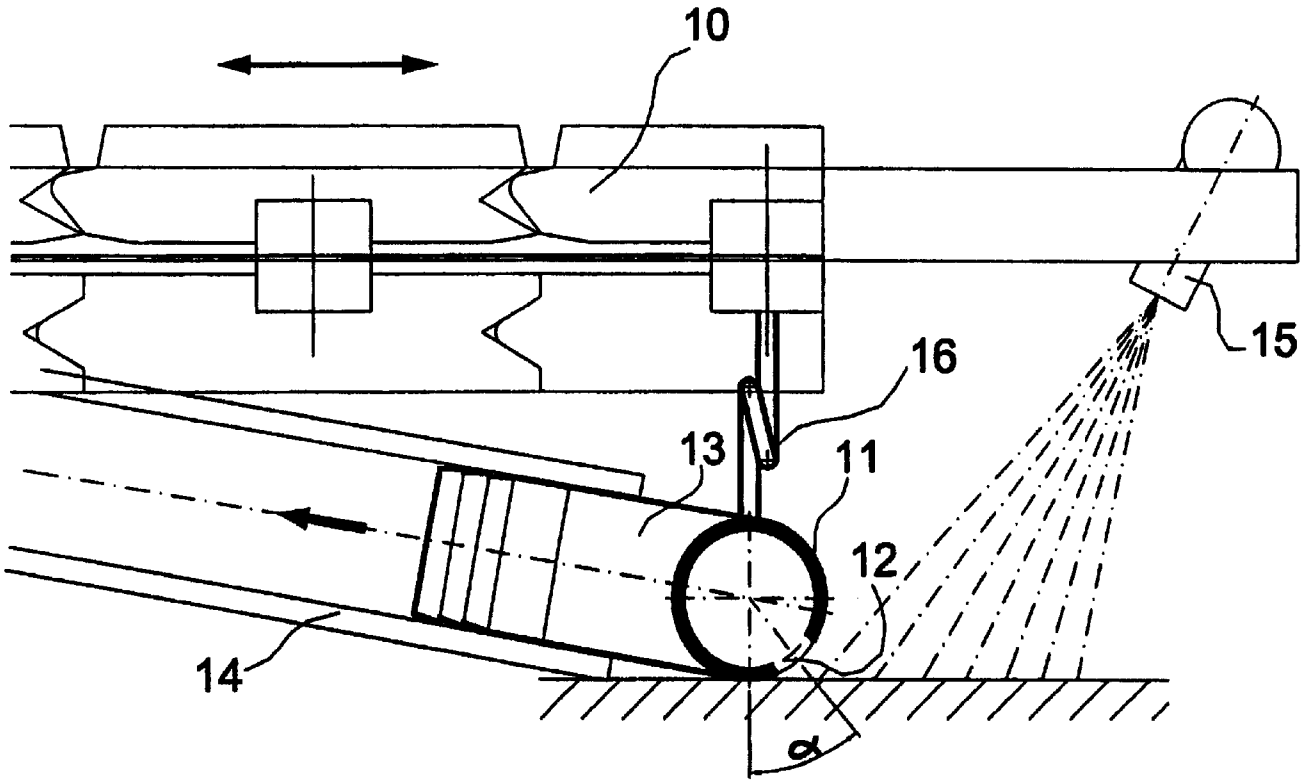
Figure 4:
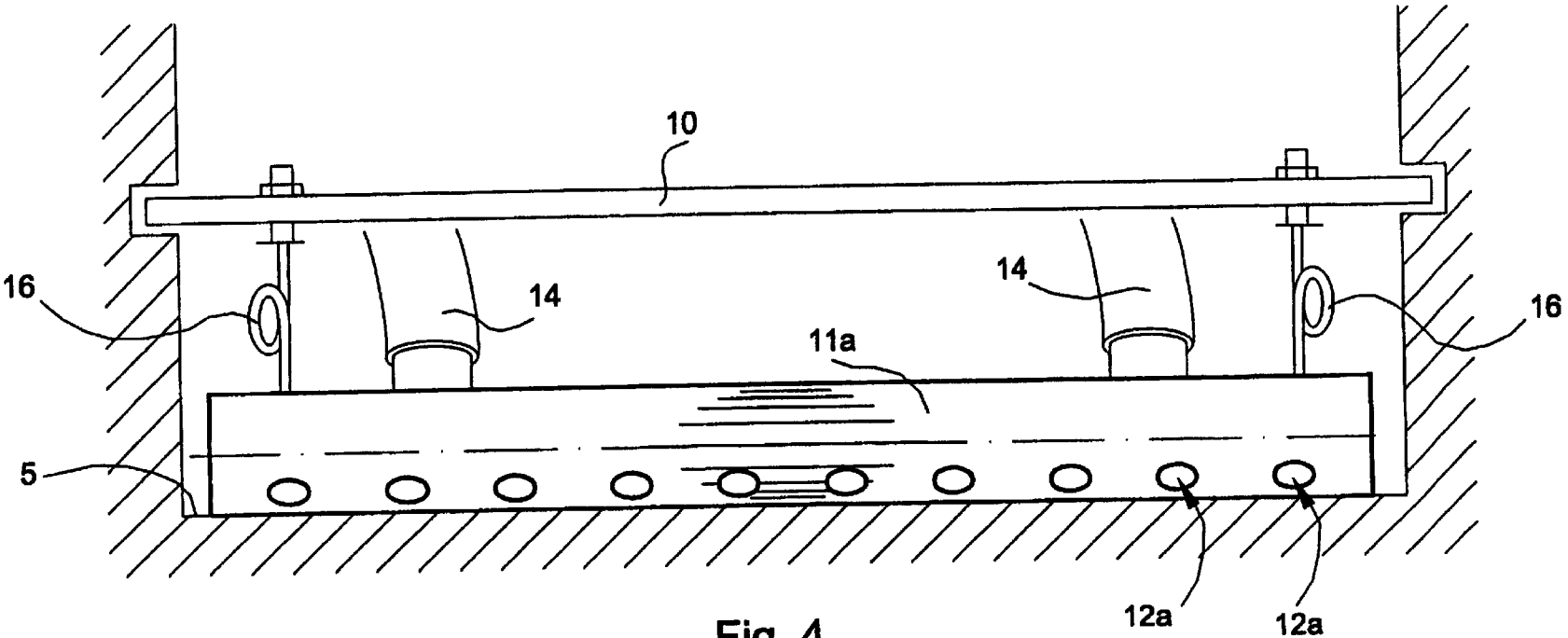
Figure 5:
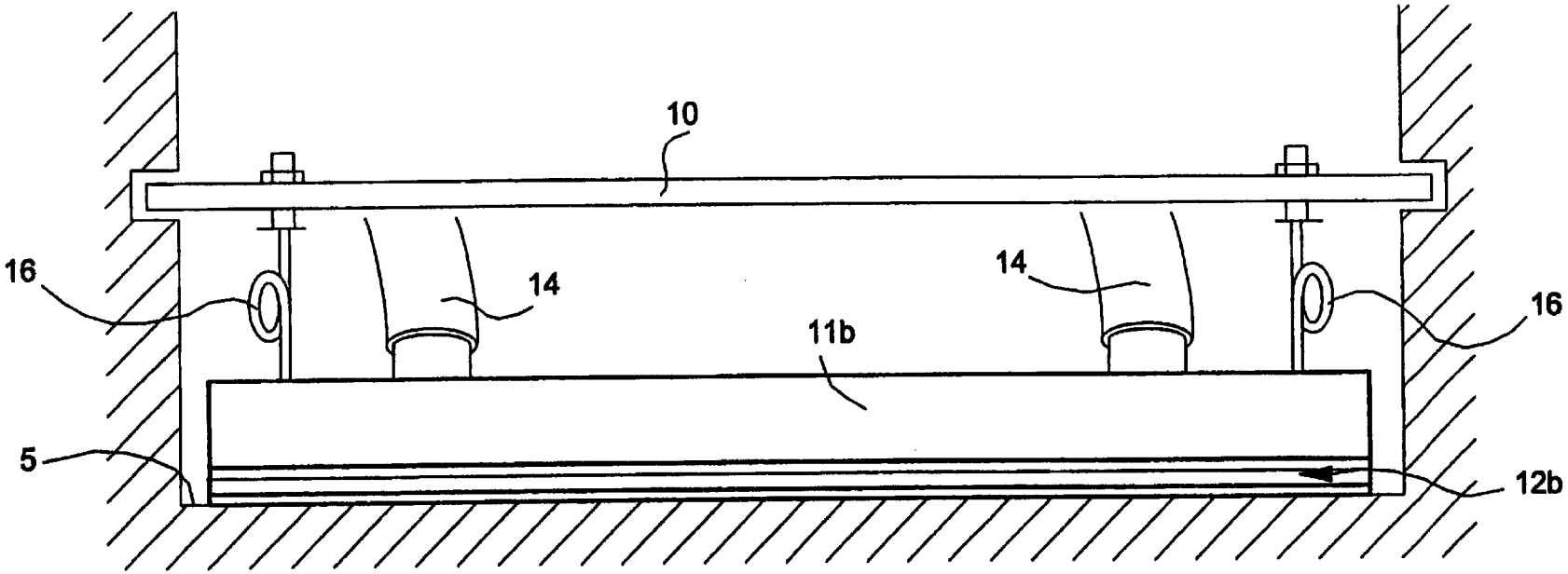
Figure 6:
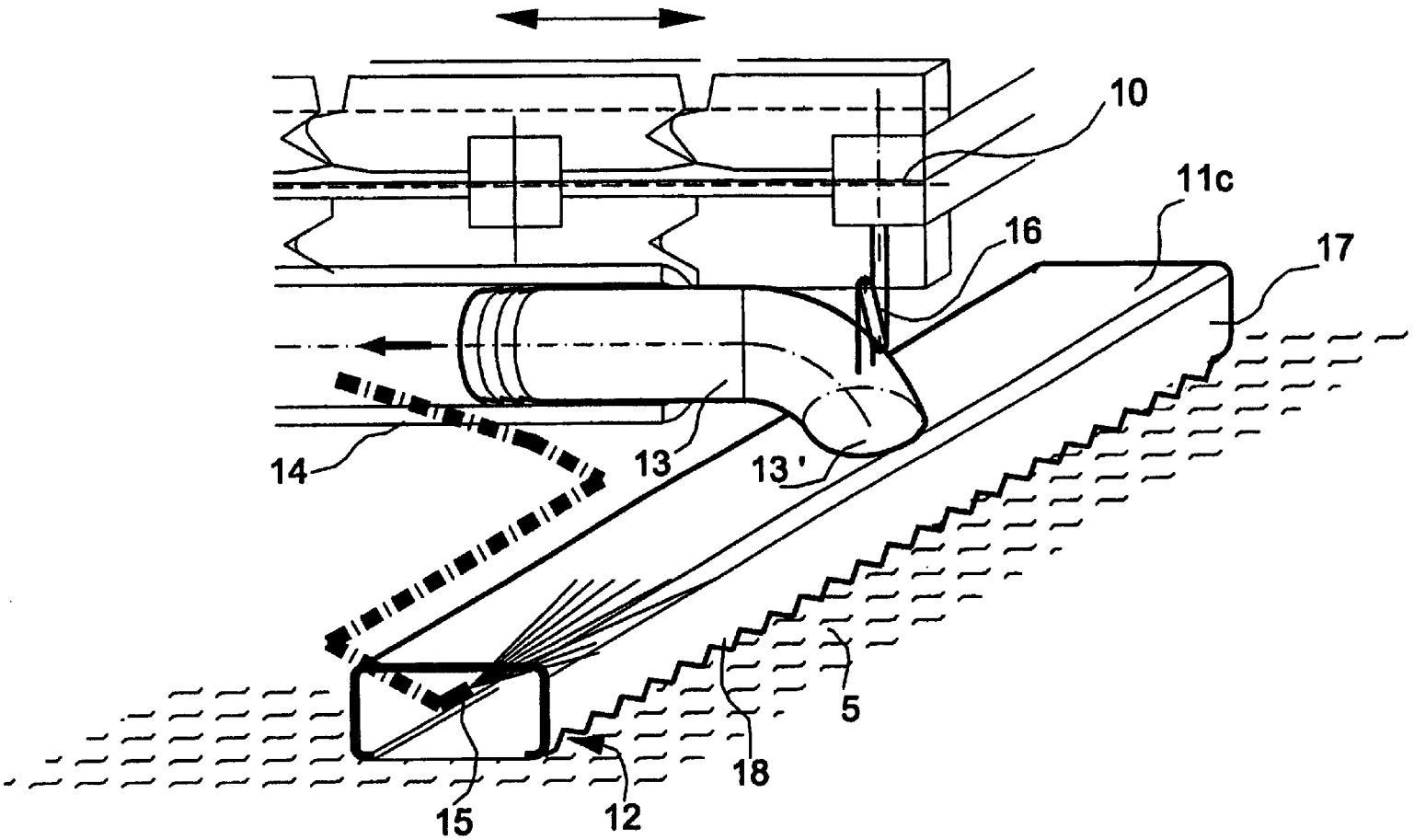

The invention is described in more detail below, with reference to the accompanying drawings, where FIG. 1 illustrates a preferred embodiment of the invention in an electrolytic tank, seen from the side in a partial cross-section, FIG. 2 illustrates the embodiment of FIG. 1, seen in the direction A—A, FIG. 3 illustrates a preferred embodiment of the arrangement according to the invention, seen from the side in a partial cross-section, FIG. 4 illustrates a fourth embodiment according to the invention, seen in the direction B—B of FIG. 3, FIG. 5 illustrates another embodiment of the invention, seen in the direction B—B of FIG. 3, and FIG. 6 is a simplified illustration of a preferred embodiment of the arrangement according to the invention.

FIGS. 1 and 2 represent a general illustration of an electrolytic tank 1, where there are in turns placed electrodes, anodes 2 and cathodes 3, and the metal to be produced in the electrolytic process is precipitated onto the cathode by means of an electrolytic solution 4 present in the electrolytic tank. During the electrolytic process, on the bottom 5 of the electrolytic tank 1 there are settled solids 6 that should be removed from the electrolytic tank from time to time.

The arrangement according to the invention for cleaning the bottom 5 of an electrolytic tank of the solids 6 settled on the tank bottom comprises elements movable along the bottom 5 or at least in the vicinity thereof in order to detach solids from the bottom. In addition, the arrangement comprises at least one movable suction element 11, whereby at least part of the solids accumulated on the tank bottom are conducted out of the tank.

The suction element 11 is an suction nozzle 11*a*, 11*b*, 11*c*, arranged essentially transversally to the motional direction of the arrangement (illustrated by arrows in FIGS. 1, 3 and 7), said suction nozzle preferably extending essentially along the whole width of the tank and being provided with at least one feed aperture 12, 12*a*, 12*b* and one discharge aperture 13. In the embodiment of FIG. 3, the suction element 11 is made of a pipe with a circular cross-section; at the bottom part of said pipe, there is formed at least one feed aperture 12, and in said pipe, there is preferably formed at least one discharge aperture 13, which can be connected to a suction conduit 14. In the embodiment of FIG. 3, the central point of the aperture 12 is located, with respect to a vertical radius drawn via the contact point of the pipe and the bottom 5, upwardly for an angle $\alpha$. The size of said angle depends on the dimensions of the pipe used as the suction nozzle housing and of the feed aperture. In one embodiment (FIG. 4), the suction nozzle 11*a* is provided with several feed apertures 12*a*. The size, shape and number of the feed apertures may vary even to a large extent from one embodiment to another.

In another embodiment of the invention (FIG. 5), the suction nozzle 11*b* is provided with an elongate, slot-like feed aperture 12*b* that extends essentially along the whole width of he suction nozzle.

In connection with the suction nozzle, there is provided at least one nozzle 15 for feeding cleaning agent. The nozzle 15 for feeding cleaning agent is directed to carry solids towards the feed apertures 12 of the suction nozzle (FIG. 3). The cleaning agent may typically be a liquid or gaseous agent or a mixture thereof. The nozzle for feeding the cleaning agent can be arranged externally to the suction element 11, but also inside thereof. In the embodiment according to FIG. 6, the cleaning nozzle 15 is arranged inside the suction nozzle 11*c*, advantageously in the end part thereof, in which case it is directed to carry solids towards the discharge aperture 13.

The suction nozzle comprises means 16 for pressing the suction nozzle towards the tank bottom 5. Typically the means 16 are for instance spring members, which are at their first end arranged in the drive arrangement 10 and at their other end in the suction element 11, 11*a*, 11*b*, 1*c*.

In a preferred embodiment (FIG. 6) of the arrangement according to the invention, in connection with the suction nozzle 11*c*, preferably at the front edge 17 thereof, there are provided means 18 for the mechanical treatment of solids, such as cogs. The housing of the suction nozzle 11*c* is made of a rectangular pipe, where in the side facing the bottom 5, there is made an aperture 12, and in the front wall 17, at the bottom edge thereof, there is made a cogging 18.

The solids conducted from the tank bottom to the suction element 11 are advantageously removed from the tank along the conduit 14.

The suction element is attached to a separating wall 10, which at the same time serves as a drive element. In connection with the electrolytic tank, preferably in the side walls 7, 8 of the tank, there are arranged support and control members 9. By means of said support and control members 9, the separating element is supported when the separating element is placed in the electrolytic tank 1, and controlled when it is being placed in the electrolytic tank, so that the created trajectory is mainly defined by said support and control members. Typically the support and control members 9 are recesses formed in the opposite walls 7, 8 of the tank, in which recesses the side edges of the separating element 10 are arranged to fit. A preferred embodiment of the separating wall is specified in U.S. Pat. No. 6,299,756.

For a man skilled in the art, it is obvious that the invention is not restricted to the above described embodiments exclusively, but it can be modified within the appended claims. Thus the arrangement may comprise several different suction nozzles, even placed transversally to the motional direction of the arrangement.

What is claimed is:

1. An electrolytic apparatus comprising:

an electrolytic tank having a bottom, and an arrangement for removing solids that have settled on the bottom of the electrolytic tank, said arrangement comprising an elongate suction element disposed in the tank close to the bottom of the tank and extending substantially parallel to the bottom of the tank, and a drive means for moving the suction element over the bottom of the tank in a direction transverse to the length of the suction element.

2. An apparatus according to claim 1, wherein the suction element is a suction nozzle provided with at least one feed aperture and at least one discharge aperture.

3. An apparatus according to claim 2, wherein the tank has a width dimension and a length dimension, the suction element extends over substantially the entire width dimension of the tank and the drive means moves the suction element in the length dimension of the tank.

4. An apparatus according to claim 1, wherein the suction element comprises a housing having a bottom part formed with at least one feed aperture.

5. An apparatus according to claim 4, wherein the housing is formed with at least one discharge aperture and the apparatus comprises a suction conduit connected to the discharge aperture.

6. An apparatus according to claim 1, wherein the suction element comprises a housing provided with an elongate, slot-like feed aperture extending over substantially the entire length of the suction element.

7. An apparatus according to claim 1, further comprising a nozzle for feeding cleaning agent.

8. An apparatus according to claim 7, wherein the suction element has at least one feed aperture and the nozzle for feeding cleaning agent is positioned for directing solids towards the feed aperture of the suction element.

9. An apparatus according to claim 7, wherein the suction element has at least one discharge aperture and the nozzle for feeding cleaning agent is positioned and directed to convey solids towards the discharge aperture of the suction element.

10. An apparatus according to claim 1, comprising a means for pressing the suction element towards the bottom of the tank.

11. An apparatus according to claim 1, comprising a means for mechanical treatsment of solids on the bottom of the electrolytic tank.

12. An apparatus according to claim 11, wherein the means for mechanical treatment is attached to the suction element at a front edge thereof.

13. An apparatus according to claim 1, further comprising a moveable wall for separating a lower region of the tank from an upper region of the tank and wherein the suction element is attached to the moveable wall.

14. An electrolytic apparatus comprising:

an electrolytic tank having a bottom, and an arrangement for removing solids that have settled on the bottom of the electrolytic tank, said arrangement comprising a hollow elongate suction element disposed in the tank close to the bottom of the tank and extending substantially parallel to the bottom of the tank, the suction element having a wall that defines an interior space and is formed with at least one aperture, a means for applying suction to the interior space of the suction element, and a drive means for moving the suction element over the bottom of the tank in a direction transverse to the length of the suction element.

15. An apparatus according to claim 14, further comprising electrodes suspended within the tank, the electrodes being spaced from the bottom of the tank, and wherein the suction element is located in the space between the electrodes and the bottom of the tank.

16. A method of operating an electrolytic apparatus that includes an electrolytic tank having a bottom, said method comprising removing solids that have settled on the bottom of the electrolytic tank by:

placing a hollow elongate suction element in the tank so that the suction element is close to the bottom of the tank and extends substantially parallel to the bottom of the tank, the suction element having a wall that defines an interior space and is formed with at least one aperture, applying suction to the interior space of the suction element, and moving the suction element over the bottom of the tank in a direction transverse to the length dimension of the suction element.

17. A method according to claim 16, comprising supplying cleaning agent to the suction element.

18. A method according to claim 16, comprising pressing the suction element towards the bottom of the tank.

19. A method according to claim 16, comprising mechanically treating solids on the bottom of the electrolytic tank while moving the suction element over the bottom of the tank.

* * * * *